US005810248A

United States Patent [19]

Vielberth

[11] Patent Number: 5,810,248

[45] Date of Patent: Sep. 22, 1998

[54] METHOD FOR THE PREVENTION OR ELIMINATION OF FOG OVER A TERRAIN, AS WELL AS SYSTEM FOR THE PERFORMANCE OF THIS METHOD

[75] Inventor: Johann Vielberth, Zeitlarn, Germany

[73] Assignee: Institut fur Entwicklung und Forschung Dr. Vielberth KG, Germany

[21] Appl. No.: 537,735

[22] PCT Filed: Apr. 16, 1994

[86] PCT No.: PCT/DE94/00423

§ 371 Date: Oct. 12, 1995

§ 102(e) Date: Oct. 12, 1995

[87] PCT Pub. No.: WO94/25685

PCT Pub. Date: Nov. 10, 1994

[30] Foreign Application Priority Data

| | | | |
|---|---|---|---|
| Apr. 30, 1993 | [DE] | Germany | 43 14 194.3 |
| Jun. 5, 1993 | [DE] | Germany | 43 18 762.5 |
| Jun. 16, 1993 | [DE] | Germany | 43 19 850.3 |

[51] Int. Cl.[6] ..... A01G 15/00; E01H 13/00

[52] U.S. Cl. ..... 239/2.1; 239/14.1; 244/114 R

[58] Field of Search ..... 239/2.1, 14.1; 244/114 R

[56] References Cited

U.S. PATENT DOCUMENTS

| | | | |
|---|---|---|---|
| 2,052,626 | 9/1936 | Houghton . | |
| 3,598,313 | 8/1971 | Plattner . | |
| 3,851,822 | 12/1974 | Pocrnja et al. | 239/2.1 |
| 4,781,326 | 11/1988 | Keller | 239/14.1 X |

FOREIGN PATENT DOCUMENTS

| | | |
|---|---|---|
| 169746 | 1/1986 | European Pat. Off. . |
| 649612 | 10/1964 | France . |

*Primary Examiner*—Andres Kashnikow
*Assistant Examiner*—Robin O. Evans
*Attorney, Agent, or Firm*—Bierman, Muserlian and Lucas

[57] ABSTRACT

The invention concerns a method of preventing or eliminating fog over an area of land, for example an aircraft runway, a motorway carriageway, part of a road or some other area. The method calls for water to be sprayed through several nozzles into a given body of air over the area to form finely divided water droplets. The invention also concerns a system for carrying out this method.

12 Claims, 5 Drawing Sheets

Figure 1:
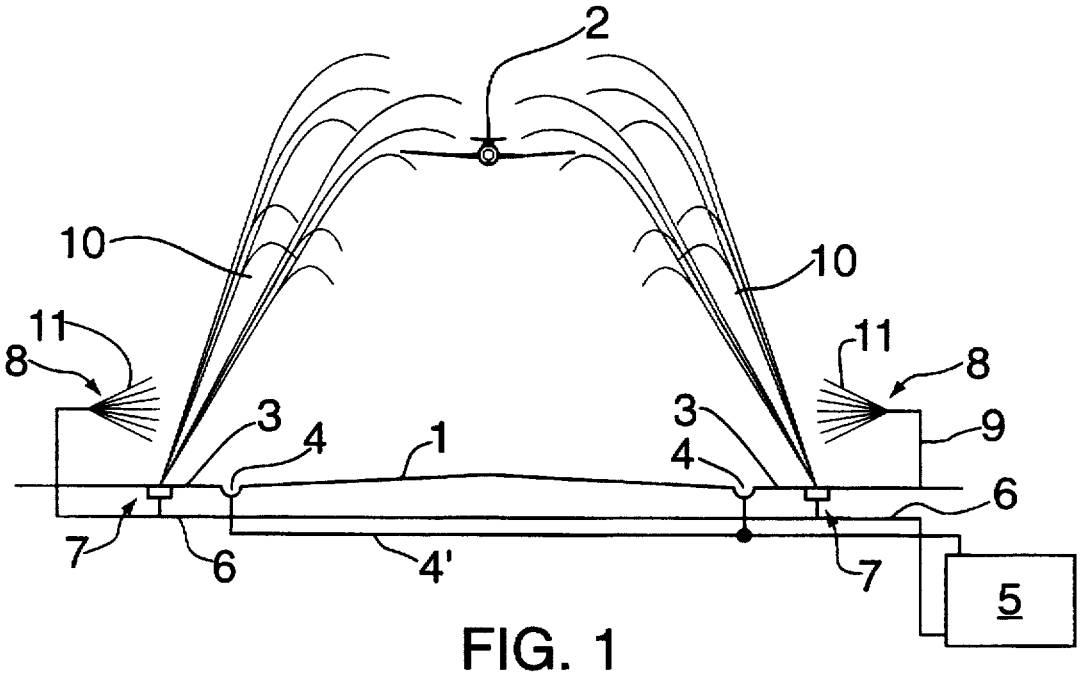

METHOD FOR THE PREVENTION OR ELIMINATION OF FOG OVER A TERRAIN, AS WELL AS SYSTEM FOR THE PERFORMANCE OF THIS METHOD

The invention relates to a method according to the generic clause of claim 1, as well as to a system for the performance of this method according to the generic clause of claim 7.

A method for the elimination of ground fog in the region of a landing or takeoff strip for aircraft has been disclosed (EP 0,169,746). In this known method, water is sprayed into the air volume over the takeoff strip through nozzles which are provided at the longitudinal sides of the strip, specifically, for the purpose of removing the fog droplets present in the air from the air by collision and combination with the sprayed water and thereby causing dispersal of the ground fog. In this known method, the discharged water has a temperature that is equal to the temperature of the fog air. The dispersal of fog sought by the known method through collision and combination of fog droplets with the sprayed water requires a great quantity of water.

In addition, a method for the dispersal of fog, wherein a hygroscopic material, which may be in the form of either powder or liquid, is discharged into the body of air, is likewise known (U.S. Pat. No. 2,052,626).

The object of the invention is to demonstrate a method by which elimination of fog, but alternatively even prevention of fog formation, is possible in particularly effective fashion.

To accomplish this object, a method according to the characterizing portion of claim 1 has been developed.

A system for the prevention or elimination of fog is designed according to the characterizing portion of claim 7.

In the method and/or system according to the invention, the dispersal of ground fog is effected not by the collision and/or combination of fog droplets and sprayed water, but by the removal of moisture from the respective air volume or body of air. The sprayed water, whose temperature lies distinctly below the temperature of the dew point of the air of the air volume or below the temperature of the water vapor present in this air volume, forms finely divided drops of water on which the water portion of the fog/air present as water vapor condenses, so that this water portion is removed from the fog/air or the body of air and carried away with the sprayed water. Removal of the moisture present in the body of air as water vapor causes the vapor pressure in the body of air to drop below the saturation pressure, as a result of which the droplets of fog or water forming the fog in the air volume are able to evaporate and disperse.

Upon the condensation of water vapor on the discharged or sprayed water, thermal energy is given off to the sprayed water quantity, which (thermal energy) is carried away with this water, specifically, preferably to a water-processing facility, in which cooling of the recycled water also takes place.

Evaporation of the fog and/or water droplets (droplet-like portion of the moisture in the air) forming the fog produces, through removal of energy, a certain degree of cooling of the body of air, with the result, inter alia, that this cooler, fog-free body of air remains lying in a relatively stable condition over the ground or terrain and thus is kept where a fog-free space is desired.

Under the invention water may be discharged or sprayed directly over, for example, the terrain over which the dispersal of fog is desired. In principle, however, it is alternatively possible to discharge or spray water in one or more regions which are adjacent to the terrain, and in this case, too, condensation of the vaporous portion of the moisture in the air on the sprayed or discharged water causes a reduction of the vapor pressure in the body of air and hence evaporation of the droplet-like portion of the moisture in the air not only in the region in which the water is discharged, but also over the adjacent terrain over which the fog is to be dispersed or eliminated.

The method and system according to the invention are suitable not only for the elimination of fog, but alternatively may be used preventively, specifically, before fog that is anticipated is formed because of temperature conditions and atmospheric moisture. In this preventive application, too, the vaporous portion of the moisture in the air is condensed on the discharged water and hence moisture is removed from the body of air, so that the relative humidity is reduced and kept distinctly below 100% absolute humidity (dew point).

In this case, cooling of the body of air by evaporation of fog or water droplets does not take place. If the body of air freed from fog or preventively treated for the prevention of fog formation is heated by, for example, thermal radiation, an additional reduction in relative humidity of the air is thereby produced.

The advantage of the method and/or system according to the invention consists in that, inter alia, effective prevention of fog formation or effective elimination of fog is possible with a relatively small quantity of discharged water.

Refinements of the invention are the subject matter of the subclaims.

Figure 3:
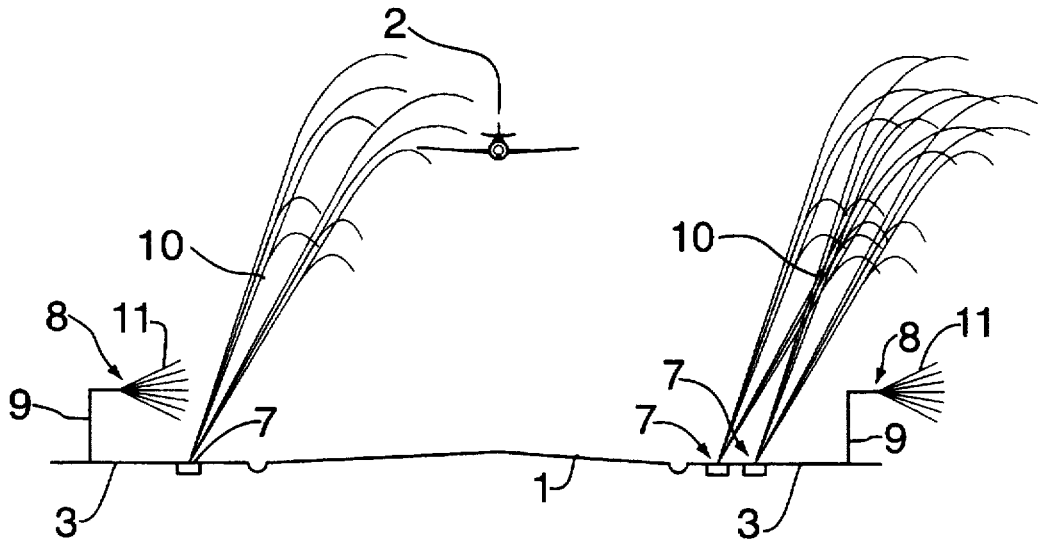
Figure 4:
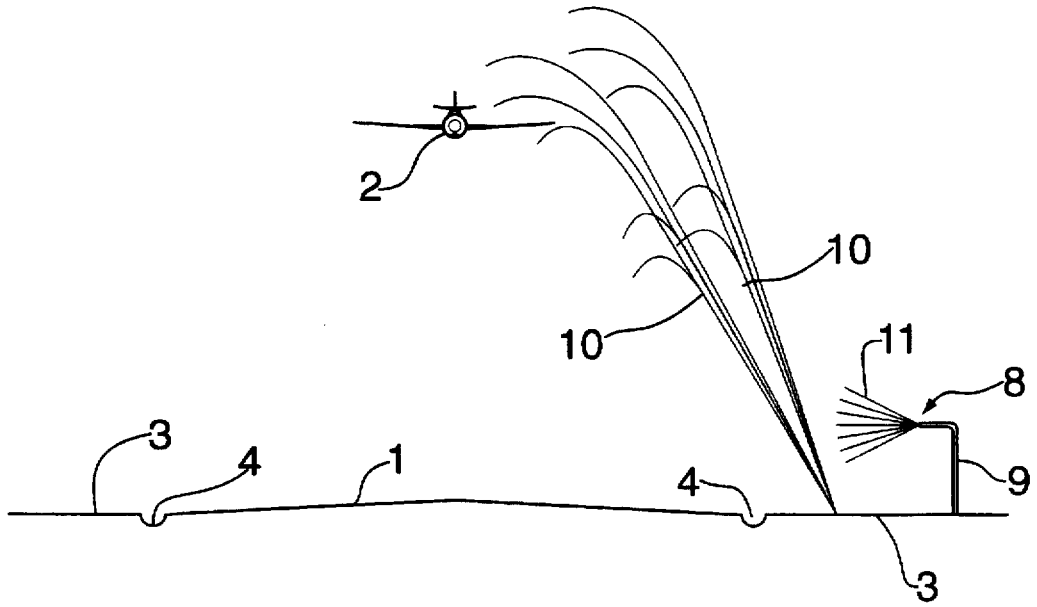
Figure 5:
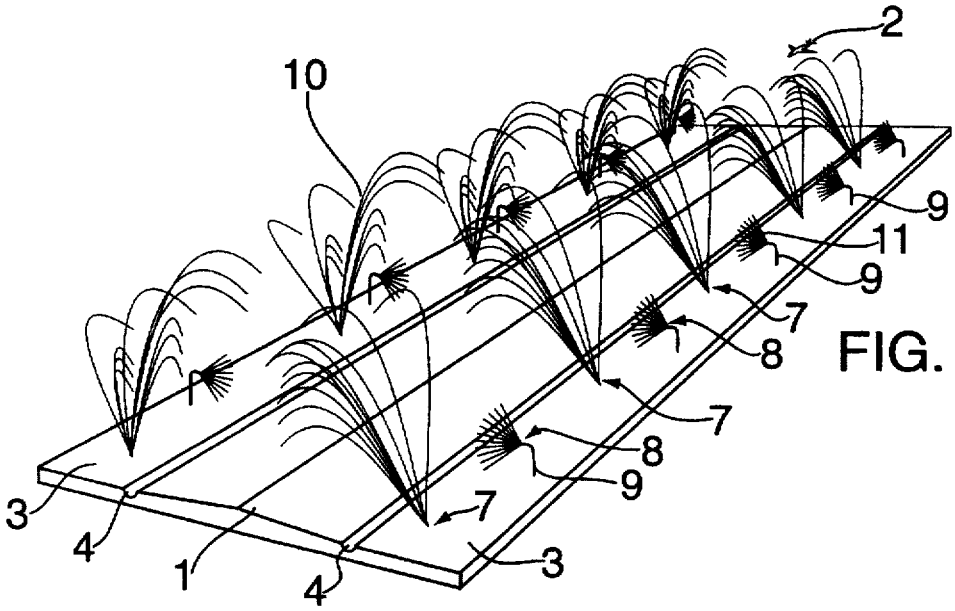
Figure 6:
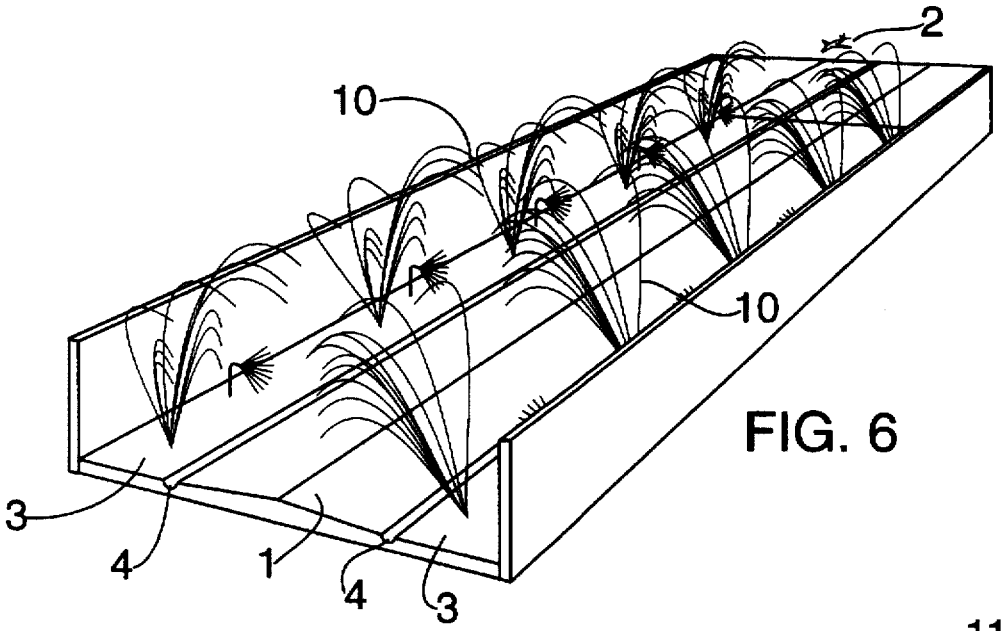
Figure 7:
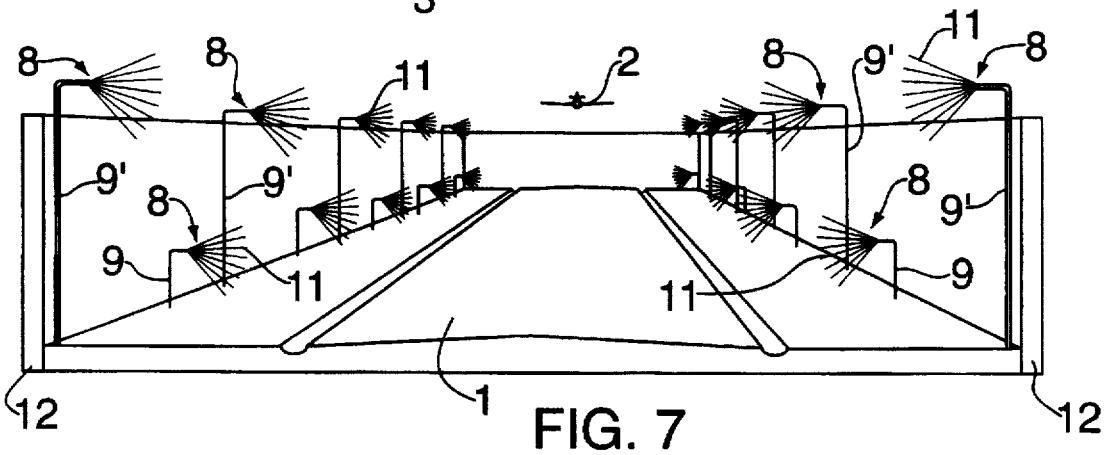
Figure 8:
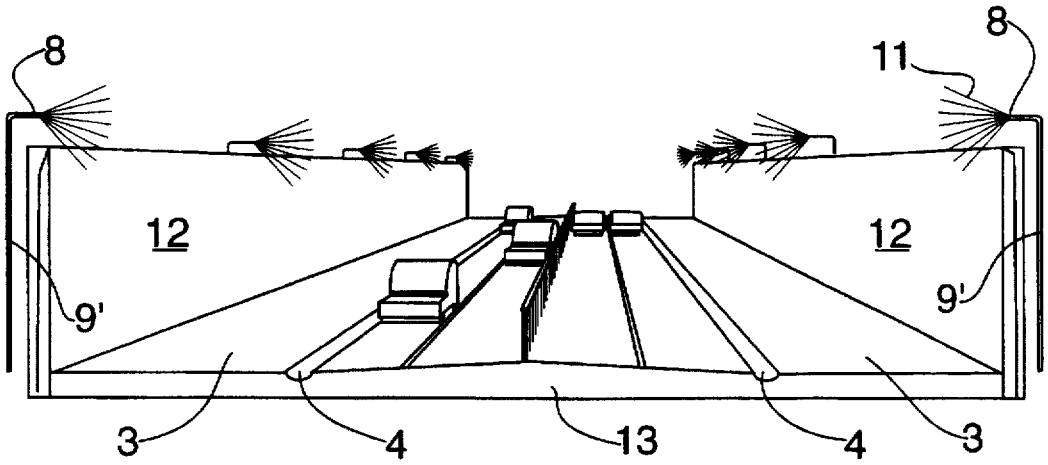
Figure 9:
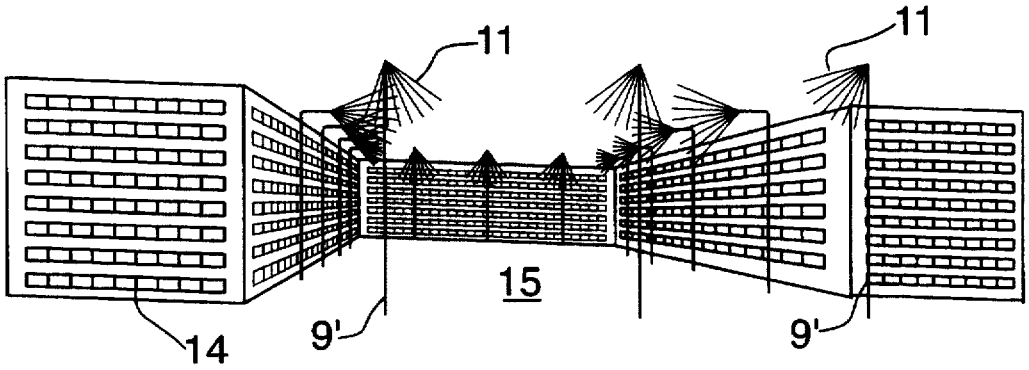
Figure 10:
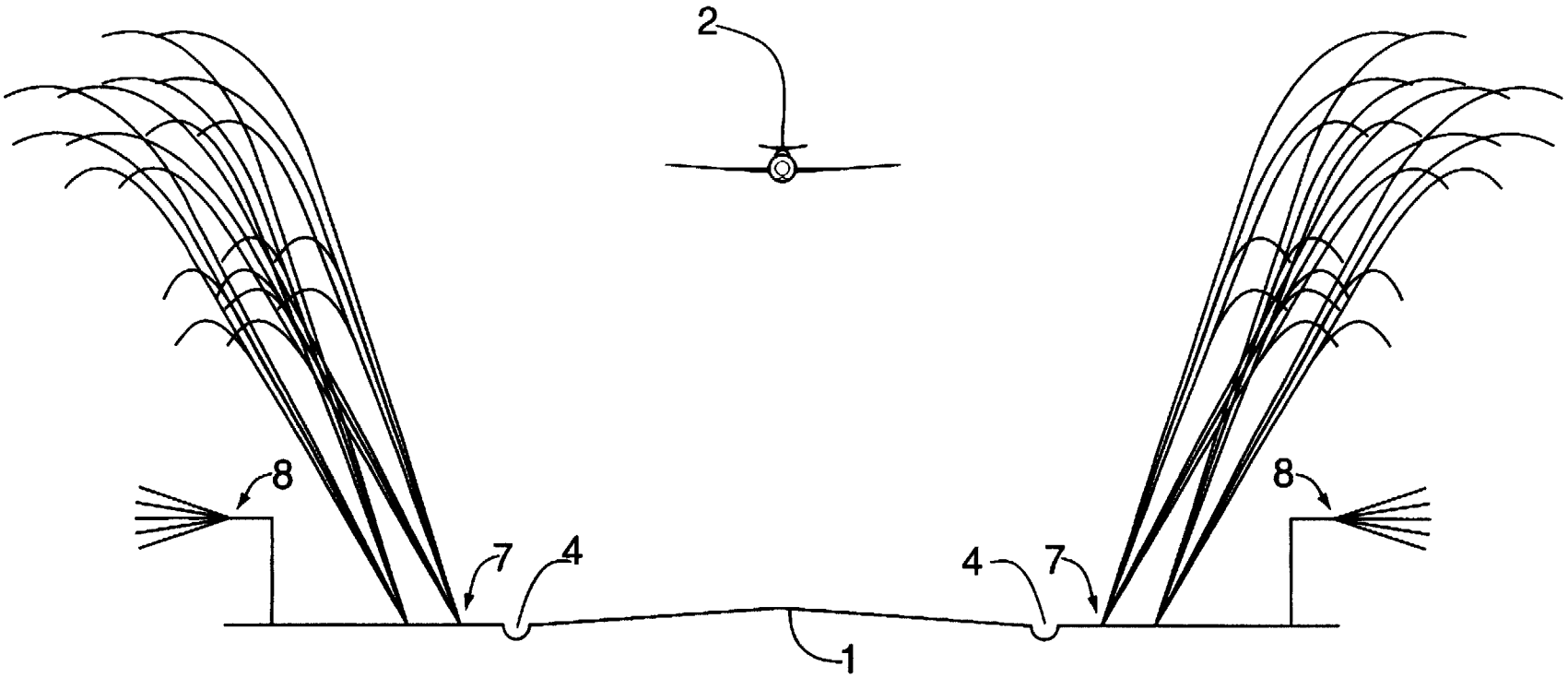

The invention is explained in detail below by way of examples, with the aid of the figures, wherein:

FIGS. 1–4 show, in simplified representation, an airfield with spraying means provided on the said airfield for discharging water, specifically, with variable position of these spraying means;

FIG. 5, in simplified perspective schematic representation, the airfield of FIGS. 1–4;

FIGS. 6 and 7, in perspective representation, additional possible embodiments of the airfield;

FIGS. 8 and 9, in schematic, perspective representation, a multilane roadway as well as a plaza delimited by buildings, together with spraying means or nozzles for performance of the method according to the invention;

FIG. 10, in a representation similar to that of FIG. 1, an additional possible embodiment of the system according to the invention or an airfield equipped with this system.

In FIGS. 1–5, 1 is a landing and/or takeoff strip, made of a concrete runway, for aircraft 2.

A strip-like marginal area 3 is provided on either side of the landing strip 1, which is likewise covered with concrete or is produced in some other way that water is able to collect on the surface of the areas 3 and flow off into a drain 4, without this water or a major part thereof going into the ground.

The drains or collecting gutters 4, which in each instance are provided on either side of the landing strip 1 and directly adjoining the latter, have a plurality of outlets, not represented, and are connected through sewer pipes 4' to a water-processing plant 5, in which the water recycled through the pipes 4', whose temperature is always colder than the temperature of the air volume, is treated, i.e., at least purified and cooled to the required temperature. The processing plant 5 is connected via pumps, not represented, as well as via a system of supply lines 6 with a plurality of nozzle arrangements 7 and 8, which are provided distributed in the areas 3, specifically, the nozzle arrangements 7 are provided directly on the ground of the respective area 3 at a short distance from the landing strip 1 and the nozzle arrangements 8 on poles, which are provided in the areas 3 at a greater distance from the landing strip 1.

In the embodiment represented, at least the nozzle arrangements 8 in each instance have a plurality of water outlet nozzles. In addition, the nozzle arrangements 7 and 8 are designed so that the effective direction of the nozzles there can be varied. For this the nozzle arrangements 7 and 8, for example, have servomotors or control elements by which the orientation of the nozzles can be varied. In addition, valves are assigned to the nozzle arrangements 7 and 8, by which these nozzle arrangements can be opened and closed individually or in groups and the quantity of water emerging per unit of time can be varied.

To avoid control elements and sources of disturbance produced by them, the nozzle arrangements 7 alternatively may in each instance be designed so that they have nozzles which are oriented in unlike directions, while then control valves in each instance conduct the emerging water to that nozzle or those nozzles which provide the desired orientation for the emerging jets of water 10 and 11. At least the jets 10 are directed obliquely upward. In the embodiment represented, the jets 11 are directed to the side in substantially horizontal direction, so that the jets 10 cover the upper region of the body of air to be freed from fog and the jets 11 cover the lower region of this body of air.

If ground fog interfering with the visibility required for takeoff or landing is located in the region of the landing strip 1, water is sprayed for a specific period of time through the nozzle arrangements 7 and 8 in a region over the landing or takeoff strip 1. This water has a temperature which lies distinctly, i.e., for example at lest 5° C. and more preferably 10° C. or more, below the temperature of the fog/air. The fine drops of water forming in the jets 10 and 11, whose temperature likewise lies distinctly below the temperature of the fog/air, work as cold condensation surfaces, on which the warmer, vaporous portion of the atmospheric moisture can condense. As a result, moisture is removed from the body of air and the vapor pressure in the body of air or in the fog/air is reduced to below the dew point, so that the droplet-like portion of the atmospheric moisture forming the fog or formed by the fog drops evaporates and therefore, with increasing continued condensation of the vaporous portion, all the fog is finally dispersed in the desired region over the landing and takeoff strip 1.

Due to condensation of the vaporous portion of the atmospheric moisture, thermal energy is supplied to the sprayed water, so that the recycled water is slightly heated, but still has a temperature distinctly below the temperature of the ambient air. The recycled water, as mentioned above, is treated in the processing plant and cooled.

Due particularly to the evaporation of the fog droplets or the droplet-like portion of the atmospheric moisture, the removal of energy results in a certain degree of cooling of the body of air. As a consequence, the fog-free body of air has a lower temperature than the air surrounding this body of air, so that the fog-free body of air, provided no air current is present, is stable and, in particular, also remains in the vicinity of the ground. If an air current is present and therefore lateral deflection of the fog-free body of air from the area of the landing strip 1 takes place, this deflection is counteracted by appropriate alignment of the nozzle arrangements 7 and 8 and hence of the water jets 10 and 11, i.e., by appropriate counterspraying.

Since in the method according to the invention the discharged or sprayed water serves only to remove moisture from the fog/air by condensation of the vaporous water portion and thereby to obtain evaporation and hence dispersal of fog droplets, the quantity of water required for the method according to the invention is relatively small. The quantity of water is determined by the heat of condensation of the removed water to be carried away.

FIG. 1 shows the orientation of the nozzle arrangements 7 and 8 as well as of the water jets 10 and 11 in a case in which the tendency to deflection of the air volume freed from fog does not exist.

Figure 2:
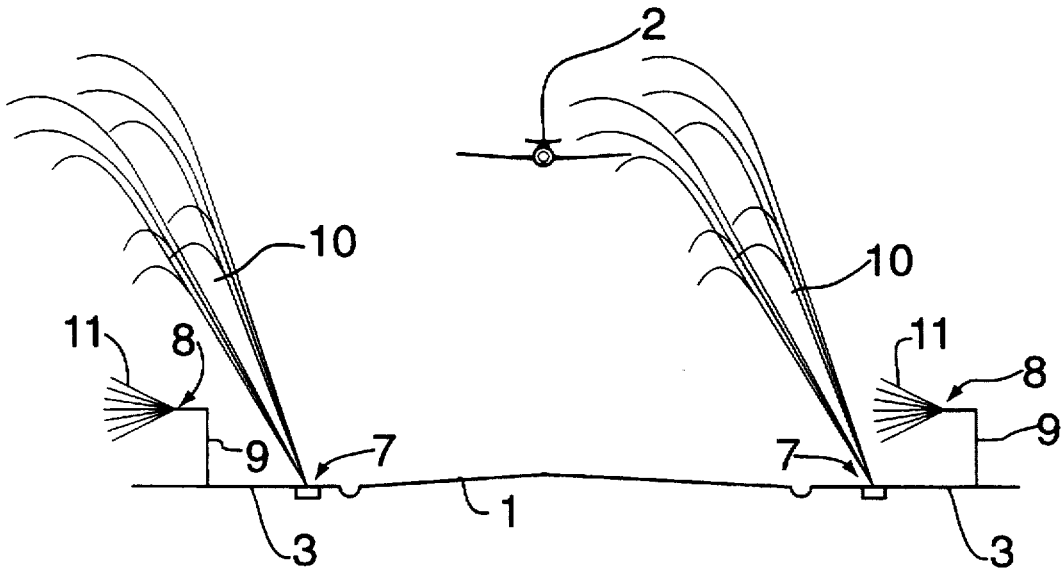

In FIGS. 2 and 3 the nozzle arrangements 7 and 8 and hence the water jets 10 and 11 are oriented or aligned so as to prevent deflection of the fog-free body of air toward the right (FIG. 2) or toward the left (FIG. 3) by counterspraying. As an additional example, FIG. 4 shows control of the nozzle arrangements 7 and 8 in such a way that these nozzle arrangements are activated on only one side of the takeoff strip.

The water discharged through the nozzle arrangements 7 and 8 flows over the landing strip 1 sloped toward the drains 4 as well as over the areas 3 likewise sloped toward these drains and, through the sewer pipes 4, reaches the processing plant 5.

If the temperature of the fog-containing air lies near the freezing point or below the freezing point, an antifreeze is admixed with the water discharged through the nozzle arrangements 7 and 8. Such admixture is effected either before the emergence of water from the nozzle arrangements 7 and 8, for example, at the processing plant 5 or in the supply system, or else directly upon the emergence of water from the nozzle arrangements. In the latter case, these nozzle arrangements have additional nozzles by which the antifreeze is introduced into the water jets 10 and 11. An adverse environmental effect or ground contamination by the antifreeze is prevented in that all the water discharged is carried through the drains 4 and sewer pipes 4' to the processing plant 5 and reused.

The method described above for the elimination of ground fog is especially effective when the landing strip 1 is located in a depression which excludes or very largely excludes air currents. If such a depression is not provided by natural geographic conditions, this can be obtained by embankments or, in the simplest case, by walls 12 which are provided on at least both sides of the areas 3, so that the landing strip 1 is located in an artificial depression or trough. In this case, too, the nozzle arrangements 7 and 8 again can be used. In the embodiment of FIG. 6, only the nozzle arrangements 7 are provided. In the embodiment of FIG. 7, the nozzle arrangements 8 are provided directly on the outer walls 12, specifically, some on the shorter poles 9 and some also on the taller poles 9'. In particular, the taller poles 9' alternatively may be arranged outside the walls 12 or outside the trough-like depression delimited by these walls.

FIG. 8 shows such an arrangement for a street with a multilane roadway 13, to which the marginal areas 3 are again adjacent on both sides, a drain 4 being provided between each marginal area 3 and the roadway 13.

FIG. 9 shows a plaza 15, surrounded by buildings 14, which is to be kept fog-free for at least specific periods. For this purpose, a plurality of poles 9' is provided distributed in the plaza 15, which in the region of their upper end in each instance bear a nozzle arrangement 8, so that with the water jet 11 emerging from the nozzle arrangements 8 elimination of fog in the manner described above is again possible.

In all the embodiments described above in connection with FIGS. 1 to 9, it has been assumed that water is discharged through the nozzle arrangements 7 and 8 over the particular area to be freed from fog.

However, as FIG. 10 shows, in principal it is alternatively possible to discharge water through these nozzle arrangements in regions which are located laterally of the terrain to be freed from fog, namely, for example, laterally of the landing strip 1. In this case, too, the discharged water causes a reduction in the vaporous portion of the moisture contained in the fog air or in the water present there, with the result that the vapor pressure in the body of air drops and the fog droplets evaporate or disperse, specifically, not only where the water is discharged from the nozzle arrangements 7 and 8, but also in adjacent regions, namely over the landing strip 1.

In addition, it has been assumed in the preceding that the discharge of water through the nozzle arrangements 7 and 8 is intended to produce dispersal or elimination of an existing fog. However, the systems described alternatively are applicable preventively, i.e., the discharge of water through the nozzle arrangements 7 and 8 already takes place as, for example, a function of measured data (air temperature or air temperature variations and atmospheric moisture), before fog can form.

The invention has been described above by way of examples. It is understood that numerous variations and modifications are possible without departing from the inventive idea on which the invention is based.

| List of reference numerals | |
|---|---|
| 1 | Landing strip |
| 2 | Aircraft |
| 3 | Side area |
| 4 | Drain |
| 4' | Sewer pipe |
| 5 | Processing plant |
| 6 | Supply line |
| 7, 8 | Nozzle arrangement |
| 9, 9' | Pole |
| 10, 11 | Water jet |
| 12 | Wall |
| 13 | Runway |
| 14 | Building |
| 15 | Plaza |

I claim:

1. Method for the prevention or elimination of fog over a terrain, for example, over a landing and/or takeoff strip for aircraft, a roadway or a street or plaza area, etc., in which (method) water is discharged through a plurality of nozzle arrangements (7, 8) into an air volume or a body of air on the terrain for the formation of finely divided drops of water, characterized in that in a supply unit the temperature of the water to be discharged is adjusted so that the temperature of the discharged water is kept at least 5° C. below the temperature of the air of the body of air, so that water vapor present in the body of air condenses on the discharged water.

2. Method according to claim 1, characterized in that the discharged water is collected, recycled and reused, and in that the recycled water is cooled in a water-processing facility so that the temperature of the discharged water lies at least 5° C. below the temperature of the air.

3. Method according to claim 1, characterized in that the temperature of the discharged water is selected so that it lies about 10° C. below the temperature of the air.

4. Method according to claim 1, characterized in that an antifreeze is admixed with the discharged water.

5. Method according to claim 4, characterized in that admixture of the antifreeze takes place at or in the nozzle arrangements (7, 8).

6. Method according to claim 1, characterized by the use of nozzle arrangements whose direction is adjustable.

7. Method according to claim 1 wherein said nozzle arrangements have nozzles whose direction is adjustable.

8. System for the prevention or elimination of fog over a terrain, for example, over a landing and/or takeoff strip (1) for aircraft, a roadway (13) or a street or plaza area (15), etc., having a plurality of nozzle arrangements (7, 8) for the discharge of water into an air volume or a body of air on the terrain for the formation of finely divided drops of water and for the prevention or elimination of fog, and having a means by which the discharged water can be collected, recycled and reused, characterized by a water-processing facility (5) by which the discharged water can be cooled so that the temperature of the discharge water lies at least 5° C. below the temperature of the air, so that water vapor present in the body of air condenses on the discharged water and moisture is thereby removed from the body of air.

9. System according to claim 8, characterized by means for admixing an antifreeze with the discharged water.

10. System according to claim 8, characterized in that the direction of the nozzle arrangements is adjustable.

11. System according to claim 8, characterized in that the recycled water can be cooled by the water-processing facility (5) so that the temperature of the discharged water lies about 10° C. below the temperature of the air.

12. System according to claim 8 wherein said nozzle arrangements have nozzles whose direction is adjustable.

* * * * *

UNITED STATES PATENT AND TRADEMARK OFFICE

CERTIFICATE OF CORRECTION

PATENT NO. : 5,810,248

DATED : September 22, 1998

INVENTOR(S) : Johann Vielberth

It is certified that error appears in the above-indentified patent and that said Letters Patent is hereby corrected as shown below:

Column 5, lines 42-43 (claim 1), after "terrain,", delete "for example, over a landing and/or takeoff strip for aircraft, a roadway or a street or plaza area, etc.,".

Column 6, lines 23-24 (claim 8), after "terrain,", delete "for example, over a landing and/or takeoff strip (1) for aircraft, a roadway (13) or a street or plaza area (15), etc.,".

Signed and Sealed this

Twenty-ninth Day of December, 1998

*Attest:*

Bruce Lehman

BRUCE LEHMAN

*Attesting Officer*

*Commissioner of Patents and Trademarks*